United States Patent [19]

Williams

[11] 4,018,198

[45] Apr. 19, 1977

[54] EXHAUST GAS RECIRCULATING SYSTEM

[75] Inventor: Elmer A. Williams, Gardena, Calif.

[73] Assignee: Rockwell International Corporation, El Segundo, Calif.

[22] Filed: Aug. 7, 1974

[21] Appl. No.: 495,360

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 3,446,196 | 5/1969 | Daigh | 123/119 A |
| 3,512,509 | 5/1970 | Daigh | 123/119 A |
| 3,799,133 | 3/1964 | Frank | 123/119 A |
| 3,807,376 | 4/1974 | Glockler et al. | 123/119 A |
| 3,809,038 | 5/1974 | Young | 123/119 A |

*Primary Examiner*—Wendell E. Burns
*Attorney, Agent, or Firm*—Charles T. Silberberg

[57] ABSTRACT

An exhaust gas recirculation system for a vehicle internal combustion engine recirculates exhaust gases to the intake manifold of the engine to reduce smog-producing exhaust emission. Exhaust gases are recirculated into the intake manifold only during certain vehicle operating conditions. An injection means responsive to application of intake manifold vacuum governs injection of exhaust gases into the intake manifold. A vacuum control means allows application of intake manifold vacuum to the injection means only when activated. A control means responsive to vehicle operating parameters selectively activates the vacuum control means. With application of vacuum, the injection means allows recirculation of exhaust gases into the intake manifold.

3 Claims, 4 Drawing Figures

EXHAUST GAS RECIRCULATING SYSTEM

BACKGROUND OF THE INVENTION

This invention relates to a vehiclar air-pollution preventive system. More particularly, it relates to a system for controlling the recirculation of exhaust gases back into the engine to the intake manifold only during certain vehicle operating conditions. No exhaust gas recirculation occurs when the specified conditions are not met.

The recirculation of exhaust gases into an internal combustion engine reduces the amount of unburned hydrocarbons and other undesirable elements that might otherwise pass into the atmosphere, and also reduces the oxygen availability to thereby lower the peak combustion temperatures and pressure and, therefore, oxides of nitrogen.

However, such recirculation hinders engine performance particularly during certain modes of engine operation. Continuous recirculation of the exhaust gases without reference to the engine operating parameters, as is generally the practice, results in unstable engine operation, decreased engine output, and contamination within the engine and, as such, is considered unsuitable for practical purposes. The present invention, provides for selectively recirculating exhaust gases only when the vehicle is driven under predetermined conditions in which the quantity of nitrogen oxides normally emitted would be of consequence.

Other exhaust gas recirculation systems for selectively recirculating exhaust gases have been devised. For example, U.S. Pat. Nos. 3,646,764 and 3,636,934, both to Nakajima, et al., disclose a normally closed solenoid valve which governs recirculation to the intake manifold which is activated by a signal passing through a plurality of series connected switches. Each switch is dependent upon an engine operating parameter and is closed allowing the signal to pass only when that parameter is above a preselected valve. However these devices have not been practical because of the additional expense and space required by the parameter responsive switches and their wiring and most significantly because the solenoid valve has to be very large to allow the required exhaust gas recirculation flow into the intake manifold. This requires a very expensive solenoid valve and puts a large drain on the battery for activation. In addition, the use of the parameter control switches is not very accurate or quickly responsive.

U.S. Pat. No. 3,768,452 to Lewis uses two vacuum control valves connected serially to allow exhaust gas recirculation except at idle and wide open throttle. However, accuracy is severely limited as recirculation depends only upon one parameter-intake manifold vacuum, and is limited to the accuracy and activation time of a spring which is subject to large hysteresis effects. Similarly, U.S. Pat. No. 3,783,847 to Kolody discloses a vacuum operated valve which controls exhaust gas recirculation. The vacuum applied is either spark port vacuum or e.g.r. port vacuum which is dependent upon the position of a solenoid actuated selector valve. The solenoid valve is actuated by a circuit employing engine parameter sensitive switches which are closed when the respective engine parameters are above pre-selected values. In this patent, the vacuum rather than being selectively applied to the vacuum responsive control valve, is constantly applied. Also, this invention is subject to the problems of accuracy, space, and expense in employing the parameter sensitive switches and the severe accuracy and response time problems should the spring in the vacuum control valve be used as a selective control for injection of exhaust gases.

SUMMARY OF THE INVENTION

It is, therefore, an object of the present invention to provide a relatively simple, accurate, fast responding, inexpensive, and space conserving exhaust gas recirculation system that lessens harmful exhaust emissions and minimizes the detrimental effect on vehicle performance.

It is another object of the present invention to provide an exhaust gas recirculation system where the exhaust gases are recirculated only under certain vehicle operating conditions.

It is yet another object of the present invention to provide for the selective application of intake manifold vacuum, depending on the values of selected vehicle operating parameters, to a means responsive to vacuum which governs recirculation of exhaust gases into the intake manifold.

Moreover, another object of the present invention is to provide an exhaust gas recirculation system for an electronically controlled fuel injected vehicle where the fuel injection controller has the additional function of selectively actuating a means which when actuated, allows application of intake manifold vacuum to a vacuum responsive means which governs recirculation of exhaust gases.

Other objects and advantages of the invention will become apparent upon reading the following detailed description and upon reference to the drawings.

While the invention will be described in connection with the preferred embodiment, it will be understood that it is not intended to limit the invention to those embodiments. On the contrary, it is intended to cover all alternatives, modifications, and equivalents that may be included within the spirit and scope of the invention as defined by the appended claims.

DETAILED DESCRIPTION OF THE INVENTION

Figure 1:
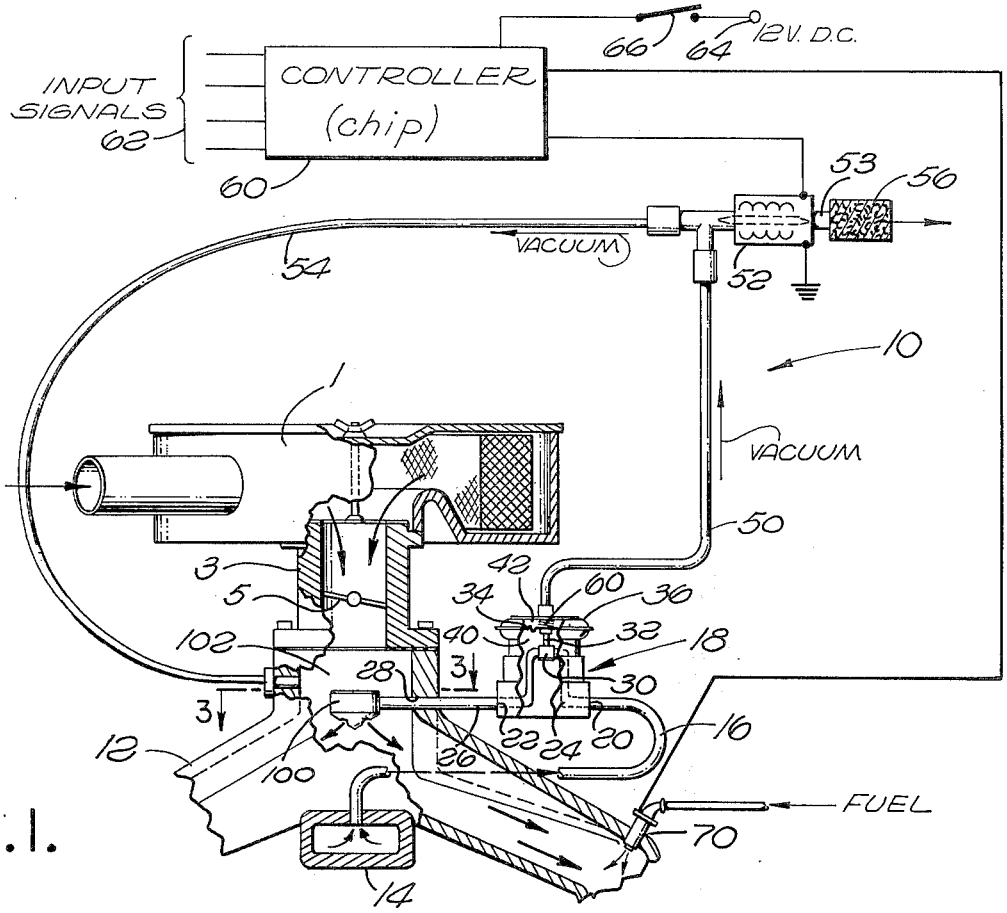
FIG. 1 is a schematic view illustrating an exhaust gas recirculating system embodying the invention with portions cut away.

Turning first to FIG. 1, there is shown an example of carrying out the invention where the exhaust gas recirculating system generally indicated at 10 is combined with a vehicle internal combustion engine (not shown). The engine has, as is customary, an intake manifold 12 and an exhaust manifold (not shown). To provide the charge for the engine cylinders (not shown), air is drawn into the air cleaner 1 and through throttle body 3 by vacuum in the intake manifold 12 under control of one or more throttle valve plates 5 rotatably mounted in throttle body 3.

A cross-over heat chamber 14 may be located on the bottom of the intake manifold 12 and leads to the exhaust manifold. Exhaust gas is removed from the cross-over heat chamber 14 or other exhaust gas source through tubing 16 when poppet valve 18 is open, thereby providing access to intake manifold vacuum.

Tubing 16 is connected to port 20 on one side of valve 18. A passage 24 within valve 18 connects port 20 with a port 22 on the opposite side of valve 18. A tube 26 is connected to port 22 and leads into intake manifold 12 sealingly projecting through an aperture 28 in the intake manifold wall.

Valve 18 governs injection of exhaust gases into the intake manifold by opening or closing passage 24 by means of a blocking member 30. Blocking member 30 is normally in the blocking position thereby preventing flow of exhaust gases from reaching tubing 26 and consequently intake manifold 12. Blocking member 30 is connected by a stem 32 to an annular flexible diaphram 34. Diaphram 34 is mounted within a hollow outer portion 36 of valve 18. Diaphram 34 divides the interior of portion 36 into an air chamber 40 and a vacuum chamber 42. Chamber 40 is connected to atmospheric pressure through a vent (not shown), while chamber 42 is connected to a vacuum source, which is preferably the intake manifold, through line 50, valve 52, and line 54. The stem 32 of valve 18 is fixed to a pair of retainers (not shown) that are secured to the diaphram 34 and serve as a seat for compression spring 60 which normally biases the blocking member 30 to its closed position. Spring 60 is selected so that minimal vacuum, such as 3 in. Hg., will overcome its force and lift the blocking member 32 to a non-blocking or open position.

The vacuum control means 52 which controls the period of application of vacuum to chamber 42 is preferably a 12 v.d.c. solenoid 3-way valve which normally vents chamber 42 to the atmosphere through tubing 50 and 53 and filter 56. This prevents application of vacuum from the intake manifold 12 to chamber 42 and locking of valve 18 in an open position by retained vacuum in line 50 and chamber 42 when valve 52 closes after allowing application of vacuum.

Valve 52 is actuated by a signal from controller 60 and remains actuated for the duration of the signal. When actuated, valve 52 will close the passage to tubing 53 and open the passage between tubing 54 and 50. This provides access from chamber 42 of valve 18 to the intake manifold 12.

A controller 60 receives input signals 62 from sensing devices 63 which correspond to selected vehicle operating conditions. The controller 60 is an electronic control unit which is adapted to receive the input signals and to transmit a pulse to control means 52 under certain conditions. Current is received by controller 60 from the battery 64 through ignition switch 66. The controller 60 could also have additional functions, as when the system of this invention is used in an emission control system which utilizes fuel injection. This type of controller would additionally have circuits for converting signals from the input sensors 63 to electrical pulses transmitted through one or more lines 94 to open one or more injection valves 70 with a specified timing and duration. Such circuits are well known in the prior art a preferred construction of controller 60 is described in U.S. Pat. No. 3,816,717 to Yoshida et al. Circuitry for the control of fuel injection and EGR can be selected to be integrated circuits and constructed in modular form for simple construction and maintenance. Such integrated modules can be easily incorporated with one another in well-known manner. By using the controller to control fuel injection and exhaust gas recirculation, it is likely less sensors would be required due to overlap in the sensed parameters required by these systems thereby saving cost and space. Additionally, an overall emission control is achieved governing fuel--air--exhaust gas mixture.

Figure 2:
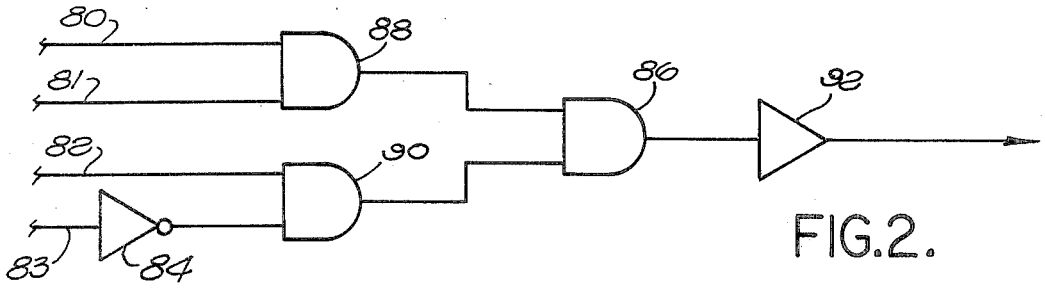
FIG. 2 shows a preferred embodiment of a control circuit, in logic schematic form, for the system.

A logic circuit which can be used for the controller for selectively activating vacuum control means 52 is illustrated in FIG. 2. Connections 80, 81, 82, and 83 transmit input signals from the sensors 63. In the preferred embodiment, 80 represents engine temperature, 81 represents transmission position, 82 represents engine R.P.M., and 83 represents intake manifold vacuum. Each sensor produces a binary 1 output when the magnitude of the vehicle operating condition sensed exceeds its threshold value. For example, with engine temperature having a threshold value of 160° F., a binary 0 output will be produced until the threshold value is exceeded, whereupon a binary 1 output is produced. Other representative threshold values are high gear position for transmission position, 1,250 R.P.M. for engine R.P.M., and 14 in. Hg. for intake manifold vacuum. The circuit is designed so that an output signal is produced only if signals, 80, 81, and 82, are binary 1 and signals 83 is binary 0. AND gate 86 will not produce a true signal unless both its input signals are binary 1. For the inputs to AND gate 86 to be both binary 1, AND gates 88 and 90 must have both their respective inputs as binary 1. These inputs are binary 1 when the threshold values of only sensors 80, 81, and 82 are exceeded. By virtue of inverter 84, a binary 1 input on line 83 into AND gate 90 is produced only when the inverter 84 receives a binary 0 input signal from the intake manifold vacuum sensor. This occurs only when the vacuum is less than the threshold value of 14 in. Hg. The output of AND gate 86 is connected to amplifier 92 which on receiving a true signal, supplies controlling current through the line 93 to valve 52. A signal produced will be terminated if any one or more of the input signals to AND gates 88 and 90 are binary 0. Thus, application of vacuum to the injection means 18 takes place on an intermittent selected basis dependent upon vehicle operating conditions.

Figure 3:
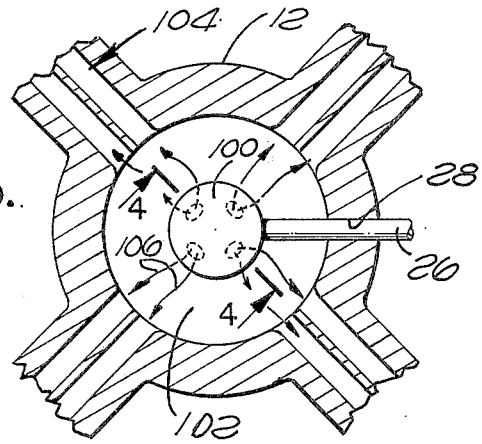
FIG. 3 is a sectional view of a preferred embodiment of a distribution means illustrating its position in the intake manifold as taken in the direction of arrows 3—3 of FIG. 1.

To improve distribution of the exhaust gases into the air stream, a distributor block 100 is provided in the intake manifold 12. It is desirable to have equal distribution of exhaust gases to all cylinders to insure proper balance so that one cylinder will not be putting out too much $NO_x$ while another is not putting out enough horsepower. As illustrated in FIGS. 1 and 3, the distributor block 100 would under ideal flow conditions and with an intake manifold 12 as shown be located centrally in the plenum area 102. The distributor block 100 serves to divide the flow of exhaust gases into four equal streams directed at the four manifold runners 104 as shown by arrows 106.

Figure 4:
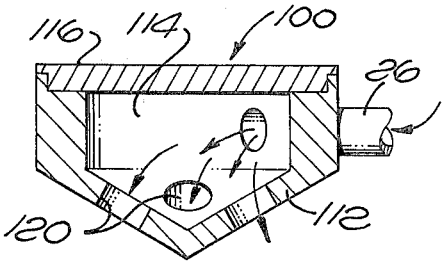
FIG. 4 is a sectional view of the distribution mechanism of FIG. 3 taken in the direction of arrows 4—4.

FIG. 4 illustrates the structure of distributor block 100. Line 26 is connected to a port 110 in the bottom wall 112 of distributor block 100. The exhaust gases flow through line 26 drawn by intake manifold vacuum into a cavity 114 which is formed by bottom wall 112 and a top wall 116. The exhaust gases are drawn from cavity 114 through four apertures 120 in bottom wall 112. Apertures 120 are of equal diameter and oriented so that an equal amount of exhaust gases is directed to each of the runners 104.

Determination of location of injection of exhaust gases and whether or not distribution block 100 is to be employed are dependent upon the type of intake manifold employed in the engine. This determination is normally made by varying the position of injection and any distribution means employed within the intake manifold until smooth engine running and low $NO_x$ emissions are achieved.

OPERATION

Referring to FIG. 1, the valve 52 will not be energized until only the threshold values of the sensors producing input signals 80, 81, and 82 are exceeded and ignition switch 66 is closed. In this condition blocking member 30 of valve 18 blocks the passage 24. Spring 60 biases blocking member 30 to its closed position as valve 52 prevents application of vacuum to chamber 42 of valve 18 so that the force of spring 60 is unopposed. Thus, when the engine is driven under conditions in which the quantity of nitrogen oxides contained in the engine exhaust gases is not such that will cause a serious air-pollution problem such as during deceleration or normal cruising, then one or more of the input signals 80, 81, and 82 will be below their threshold values and/or signal 83 will be above its threshold value and valve 52 will not be actuated by controller 60 whereby valve 18 will prevent the exhaust gases from being recirculated. During this period, engine performance is maintained.

When, however, the input signals are all within a specified range of preselected values where the engine output would normally produce a serious air-pollution problem, the controller 60 will actuate valve 52 which allows application of vacuum from intake manifold 12 through lines 54 and 50 to chamber 42 of valve 18. As the force of spring 60 is minimal, almost any amount of vacuum will overcome that force and lift diaphram 34 and the attached blocking member 30 to an open position. This allows exhaust gases to be drawn by the vacuum in the intake manifold through line 16, passage 24, line 26, and distributor block 10 (if used) into the intake manifold to mix with the air and fuel used to charge the cylinders. The flow rate of exhaust gases recirculated is dependent upon the magnitude of intake manifold vacuum and the smallest diameter among tubing 16, passage 24, and tubing 26. The exhaust gases are thus recirculated into the intake manifold 12 so that the nitrogen oxides contained in the finally discharged exhaust gases are reduced to an acceptable level.

When the throttle pedal (not shown) is fully depressed by the vehicle operator, the vacuum applied to chamber 42 of valve 18 will be too slight to overcome the spring 60. However, this driving condition arises very infrequently and when required by the prudent operator, the need for unhindered performance outweighs the momentary nonreduction of nitrogen oxides.

It can be seen from the operation of the device that solenoid valve 52 only controls the application of vacuum to poppet valve 18. As the amount of vacuum flow required to actuate valve 18 is minimal the orifice diameter of valve 52 and the power required to actuate valve 52 are relatively small. This allows for a considerable cost and power saving by usage of a small solenoid valve. Poppet valve 18 is also a relatively inexpensive item as is the solid state controller. In fact, when the controller 60 is also used for fuel injection, only the insubstantial cost of an additional circuit for exhaust gas recirculation would be required rather than a separate controller and duplication of sensors would be saved. Though the present exhaust gas recirculation system is relatively simple and inexpensive, it is also highly accurate by virtue of the higher reliability faster responding solid state circuitry which also avoids the detrimental hysteresis effects of the prior art in actuating valve 52 which as a result opens the valve 18 that allows exhaust gas recirculation.

While the invention has been described in conjunction with specific embodiments thereof, it is evident that many alternatives, modifications, and variations, will be apparent to those skilled in the art in light of the foregoing description. Accordingly, it is intended to embrace all such alternatives, modifications, and variations that fall within the spirit and scope of the appended claims.

What is claimed is:

1. An exhaust gas recirculating system for a vehicle internal combustion engine provided with an intake manifold comprising:

injection means for governing injection of exhaust gases into the intake manifold responsive to application of intake manifold vacuum;

vacuum control means for allowing application of vacuum to said injection means only when activated;

sensing means for sensing vehicle operating parameters, said parameters being transmission position, engine temperature, engine RPM, and manifold vacuum;

control means responsive to input signals from said sensing means for selectively transmitting an activating signal to activate said vacuum control means, said control means transmitting said activating signal only when all said input signals are representative of all said sensed vehicle operating parameters being within a range of preselected values; and dispersing means connected to said injection means for dispersing the exhaust gases injected into the intake manifold to all cylinders of the engine equally.

2. Apparatus as set out in claim 1 wherein the internal combustion engine is provided with fuel injectors for fuel injecting the engine and said control means also transmits signals to open said fuel injectors in response to said sensing means.

3. An exhaust gas recirculating system for a vehicle internal combustion engine comprising:

a duct connecting the exhaust gases to the engine intake manifold;

a valve normally closing the duct to prevent exhaust gas recirculation and movable by application of vacuum thereto to an open position to allow exhaust gas recirculation;

a normally closed second valve movable to an open position only when activated for allowing application of vacuum to said first valve when activated;

sensing means for sensing vehicle operating parameters, said vehicle operating parameters comprising transmission position, engine temperature, engine R.P.M., and manifold vacuum;

control means responsive to input signals from said sensing means for selectively transmitting an activating signal to activate said second valve, said control means transmitting a signal only when all said input signals from said sensing means are representative of all said sensing vehicle operating parameters being within a range of preselected values; and dispersing means connected to said duct within said engine intake manifold for dispersing the exhaust gases to all cylinders of the engine equally.

* * * * *